US010391377B1

(12) United States Patent
Sorin

(10) Patent No.: US 10,391,377 B1
(45) Date of Patent: Aug. 27, 2019

(54) BAR SECURING APPARATUS AND METHODS OF USE

(71) Applicant: Albert Sorin, Lexington, SC (US)

(72) Inventor: Albert Sorin, Lexington, SC (US)

( * ) Notice: Subject to any disclaimer, the term of this patent is extended or adjusted under 35 U.S.C. 154(b) by 0 days.

(21) Appl. No.: 16/239,042

(22) Filed: Jan. 3, 2019

Related U.S. Application Data

(60) Provisional application No. 62/613,242, filed on Jan. 3, 2018.

(51) Int. Cl.
*A63B 71/00* (2006.01)
*A63B 21/072* (2006.01)
*A63B 21/00* (2006.01)

(52) U.S. Cl.
CPC ..... *A63B 71/0036* (2013.01); *A63B 21/0724* (2013.01); *A63B 21/4035* (2015.10)

(58) Field of Classification Search
None
See application file for complete search history.

(56) References Cited

U.S. PATENT DOCUMENTS

| | | | | |
|---|---|---|---|---|
| 4,822,034 | A * | 4/1989 | Shields | A63B 21/072 482/106 |
| 7,338,416 | B2 * | 3/2008 | Smith | A63B 21/078 248/125.3 |
| 8,262,105 | B2 * | 9/2012 | Mead | B62B 3/02 224/511 |
| 8,337,370 | B2 * | 12/2012 | Rogers | A63B 71/0036 482/104 |
| 9,597,539 | B2 * | 3/2017 | Grider | A63B 17/04 |
| 9,694,233 | B2 * | 7/2017 | Chou | A63B 21/0783 |
| 9,827,460 | B2 * | 11/2017 | Staten | A63B 21/0618 |
| 10,058,728 | B2 * | 8/2018 | Kelly | F16M 13/022 |
| 10,086,226 | B2 * | 10/2018 | Nelson | A63B 21/4035 |
| 2014/0296040 | A1 * | 10/2014 | Mobley | A63B 21/078 482/104 |
| 2018/0200562 | A1 * | 7/2018 | Nesbit | A63B 21/0783 |

* cited by examiner

*Primary Examiner* — Stephen R Crow
(74) *Attorney, Agent, or Firm* — Nexsen Pruet, LLC; Todd A. Serbin

(57) ABSTRACT

A bar securing apparatus for securing a weight bar to a weight rack or rack component, comprising: an upper end; a lower end; and, a cut-out located between the upper end and the lower end, sized and shaped for placement of a weight bar with a circular cross-section therein, wherein at least one of the upper end and the lower end is configured with at least one attachment point.

16 Claims, 7 Drawing Sheets

BAR SECURING APPARATUS AND METHODS OF USE

RELATED APPLICATION

This application claims the benefit of priority under 35 USC § 119(e) of U.S. Provisional Patent Application No. 62/613,242 filed Jan. 3, 2018, the contents of which are incorporated herein by reference in their entirety.

FIELD AND BACKGROUND OF THE INVENTION

The present invention, in some embodiments thereof, relates to the exercise industry and, more particularly, but not exclusively, to a securing apparatus.

SUMMARY OF THE INVENTION

According to an aspect of some embodiments of the invention, there is provided a bar securing apparatus for securing a weight bar to a weight rack or rack component, comprising: an upper end; a lower end; and, a cut-out located between the upper end and the lower end, sized and shaped for placement of a weight bar with a circular cross-section therein, wherein at least one of the upper end and the lower end is configured with at least one attachment point.

In an embodiment of the invention, the apparatus is L-shaped and wherein the upper end and the lower end are on opposite sides of the L-shape.

In an embodiment of the invention, the apparatus further comprises a raised bump located between the cut-out and the upper end. In an embodiment of the invention, a shape of the raised bump is biased towards the cut-out to hold the bar in the cut-out.

In an embodiment of the invention, the at least one attachment point is a hole through the bar securing apparatus. In an embodiment of the invention, a plurality of attachment points are located on the bar securing apparatus to provide different positional options for attaching the bar securing apparatus to the underlying weight rack or rack component.

In an embodiment of the invention, the bar securing apparatus is substantially planar.

In an embodiment of the invention, the bar securing apparatus is one in a system of a plurality of bar securing apparatuses of varying size and shape.

In an embodiment of the invention, the bar securing apparatus is one in a system of a plurality of bar securing apparatuses configured with at least one of different sized and shaped cut-outs for accommodating at least one of different bar diameters and cross-sectional shapes.

According to an aspect of some embodiments of the invention, there is further provided method of using a bar securing apparatus to secure a weight bar to a weight rack or a rack component, the weight rack or rack component, comprising: placing the weight bar on the at least one bar holder of the weight rack or rack component; laying at least one bar securing apparatus over the weight bar, such that the weight bar is disposed in a cut-out and under a raised bump of the bar securing apparatus; securing the at least one bar securing apparatus to the weight rack or rack component, wherein the weight bar is trapped between the at least one bar holder and the at least one bar securing apparatus.

In an embodiment of the invention, the method further comprises attaching at least one bar holder to the weight rack or rack component.

In an embodiment of the invention, the method further comprises performing placing through securing on a second weight rack or rack component to connect a corresponding pair of weight rack or rack component segments using the weight bar.

In an embodiment of the invention, the method further comprises performing exercise while grasping the bar.

In an embodiment of the invention, the method further comprises securing a second bar securing apparatus on an opposite side of the weight rack or rack component, such that the weight rack or rack component is bracketed by the bar securing apparatus and the second bar securing apparatus.

In an embodiment of the invention, the method further comprises securing a second bar securing apparatus on the second weight rack or rack component on an opposite side of the bar securing apparatus, such that the second weight rack or rack component is bracketed by the bar securing apparatus and the second bar securing apparatus.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings and photographic images (collectively, "drawings"). With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF EMBODIMENTS OF THE INVENTION

Figure 1A:
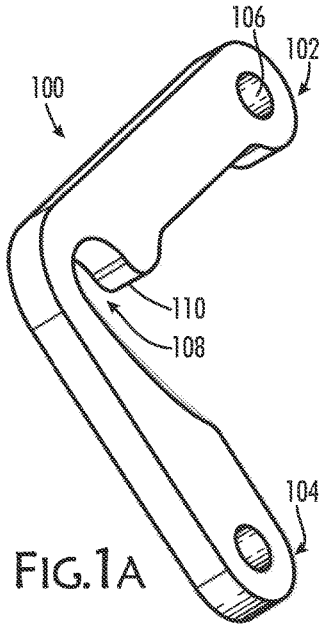
FIGS. 1A-1D are a front perspective view, a rear perspective view, a right-side view and a rear view, respectively, of a bar securing apparatus.
Figure 1B:
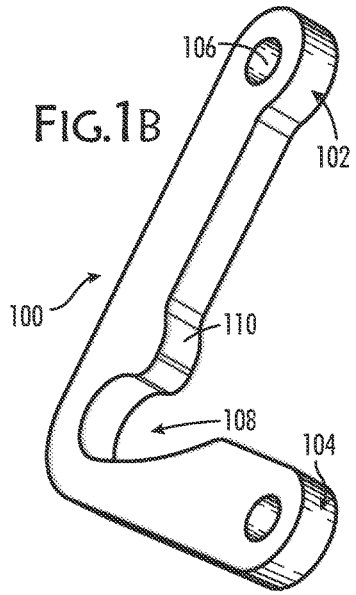

The present invention, in some embodiments thereof, relates to the exercise industry and, more particularly, but not exclusively, to a securing apparatus.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Referring now to the drawings, FIGS. 1A-1D are a front perspective view, a rear perspective view, a right-side view and a rear view, respectively, of a bar securing apparatus 100, in accordance with an exemplary embodiment of the invention. It is conceived that the bar securing apparatus 100 is used to removably secure a weight bar 302 (shown and described in more detail with respect to FIGS. 3-6), for example the Sorinex® Multi-Grip Bar™ (available on the Web at sorinex.com/product/sorinex-multi-grip), to a weight rack 400 or a rack component 450, optionally in combination with a bar holder 304 (shown and described in more detail with respect to FIGS. 3-6), for example the Sorinex® J-Hook™ available at sorinex.com/product/sandwich-style-j-cups/. Exemplary weight racks 400 include the Sorinex® Base Camp™ rack (available at sorinex.com/product/base-camp-power-rack) and an exemplary weight rack component 450 to which the bar securing apparatus 100 can be attached includes the Sorinex® Jammer Arm™ (found on the Web at sorinex.com/product/base-camp-jammer-arms).

In an embodiment, the bar securing apparatus 100 loosely resembles an L-shape, with an upper end 102 and a lower end 104, at least one end 102, 104 configured with at least one attachment point 106 (for attaching the bar securing apparatus 100 to a weight rack 400 or a rack component 450). In some embodiments of the invention, the attachment point 106 is a hole, configured for reversible insertion of a pin therethrough, where the pin will also be inserted into a corresponding hole located on the weight rack 400 or rack component 450, such that the bar securing apparatus will then be substantially immovably linked to the weight rack by the pin. In some embodiments, a plurality of attachment points 106 are located on the bar securing apparatus to provide different positional options for attaching the bar securing apparatus to the underlying weight rack 400 or rack component 450. In some embodiments of the invention, the apparatus 100 is planar when viewed from the front or rear, such as can be seen in FIG. 1D.

The bar securing apparatus 100 is provided with a cut-out 108 sized and shaped for securely positioning weight bar with a substantially circular or ovoid cross-section therein. Optionally, the bar securing apparatus 100 is offered in a plurality of sizes and/or shapes (e.g. v-shaped, round, ovoid, multi-sided), wherein at least the cut-out 108 is sized for accommodating different bar diameters and/or cross-sectional shapes. In some embodiments, the bar securing apparatus 100 is configured with a raised bump 110, biased towards the cut-out 108 to help hold the bar in the cut-out 108. In some embodiments of the invention, the bar securing apparatus is constructed of plastic, ceramic, wood or metal.

Figure 1C:
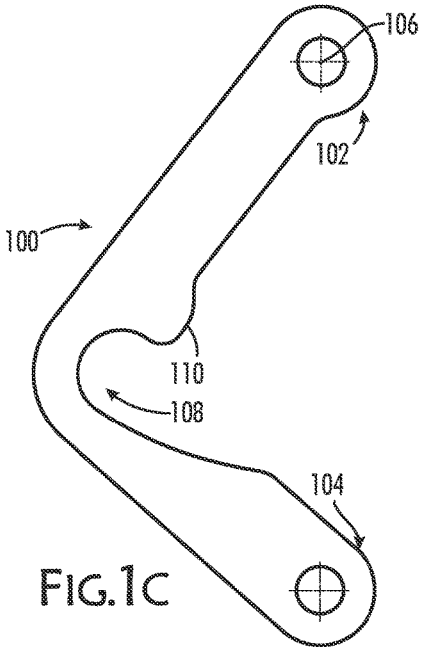
Figure 1D:
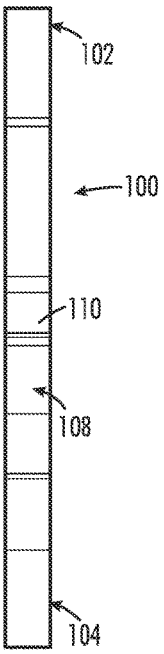
Figure 2:
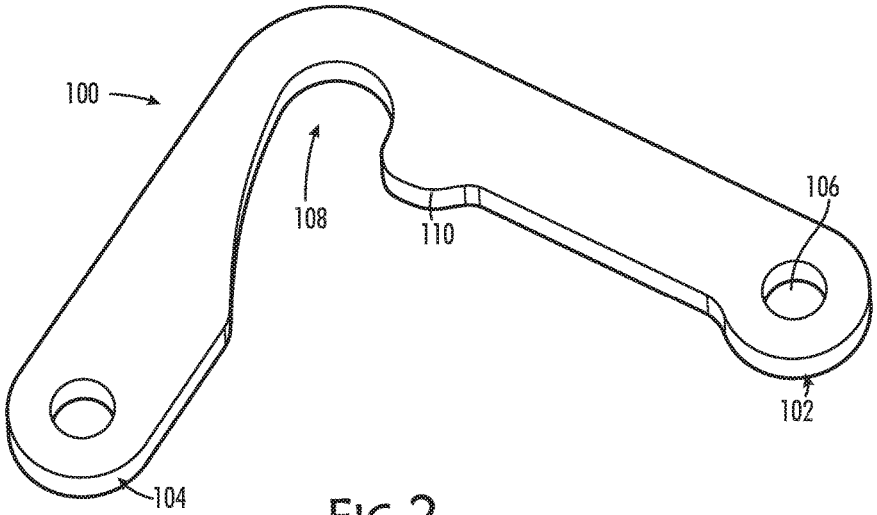
FIG. 2 is a right-side image of the weighted pivot arm apparatus of FIG. 1C.

FIG. 2 is a right-side image of the bar securing apparatus 100 of FIG. 1C, in accordance with an exemplary embodiment of the invention.

Figure 3:
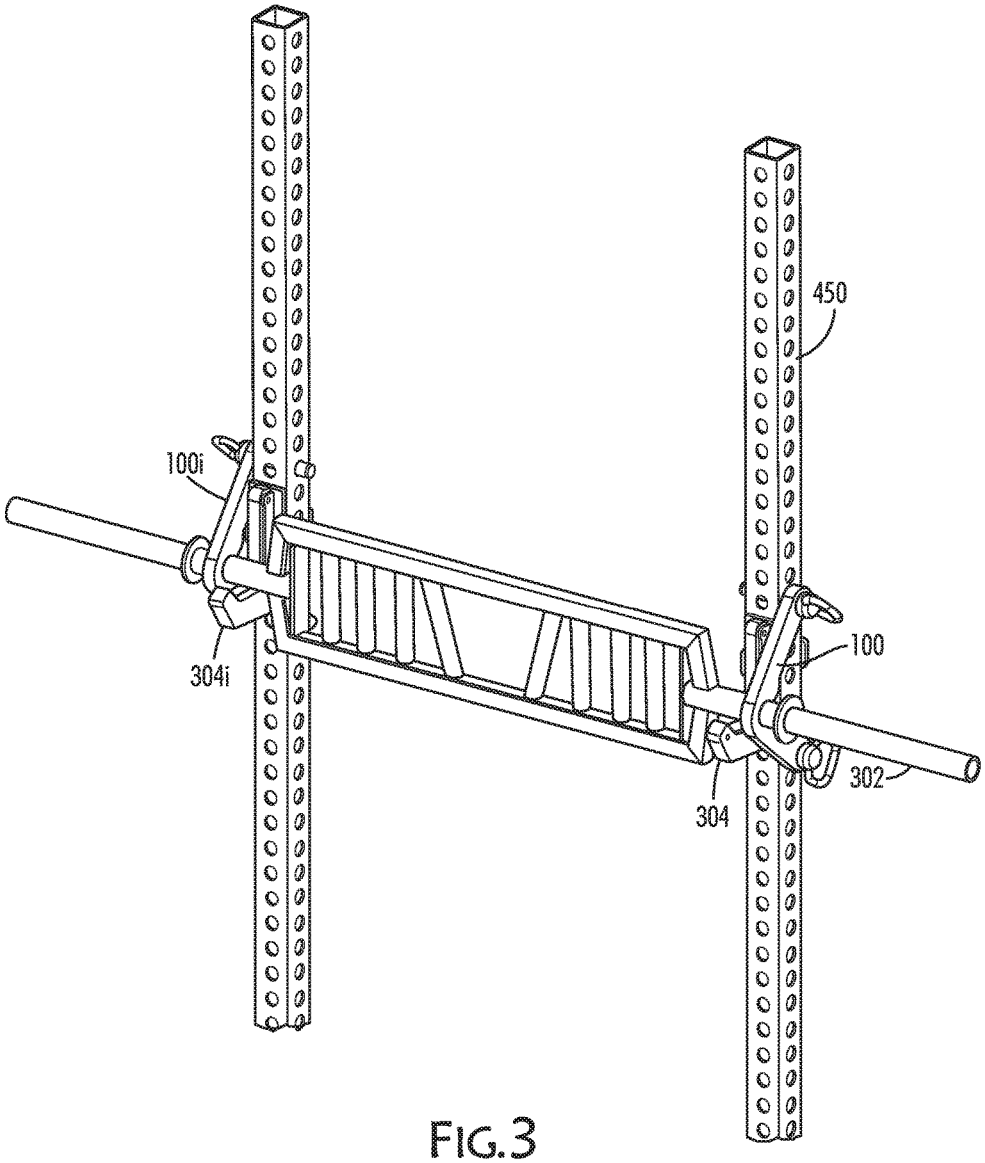
FIG. 3 is a perspective view of a pair of bar securing apparatuses attached to a weight rack or rack component.

FIG. 3 is a perspective view of a pair of bar securing apparatuses 100, **100*i* attached to a weight rack or rack component 450, in accordance with an exemplary embodiment of the invention. Also shown in FIG. 3 are a pair of bar holders 304, 304*i*, corresponding to the bar securing apparatuses 100, 100*i*, and being used in conjunction with the bar securing apparatuses 100, 100*i* to securely maintain the bar 302 on the bar holders 304, 304*i*. It should be understood that by using a hole/pin attachment system shown in FIG. 3, the bar securing apparatuses 100, 100*i* are positioned relative to the bar holders 304, 304*i* on the rack component 450 (or weight rack 400) such that the bar 302 is sandwiched between the raised bump 110 and the cut-out 108 and the "shelf" of the bar holders 304, 304*i* to prevent substantial up/down and/or forward/back movement of the bar 302**.

Figure 4:
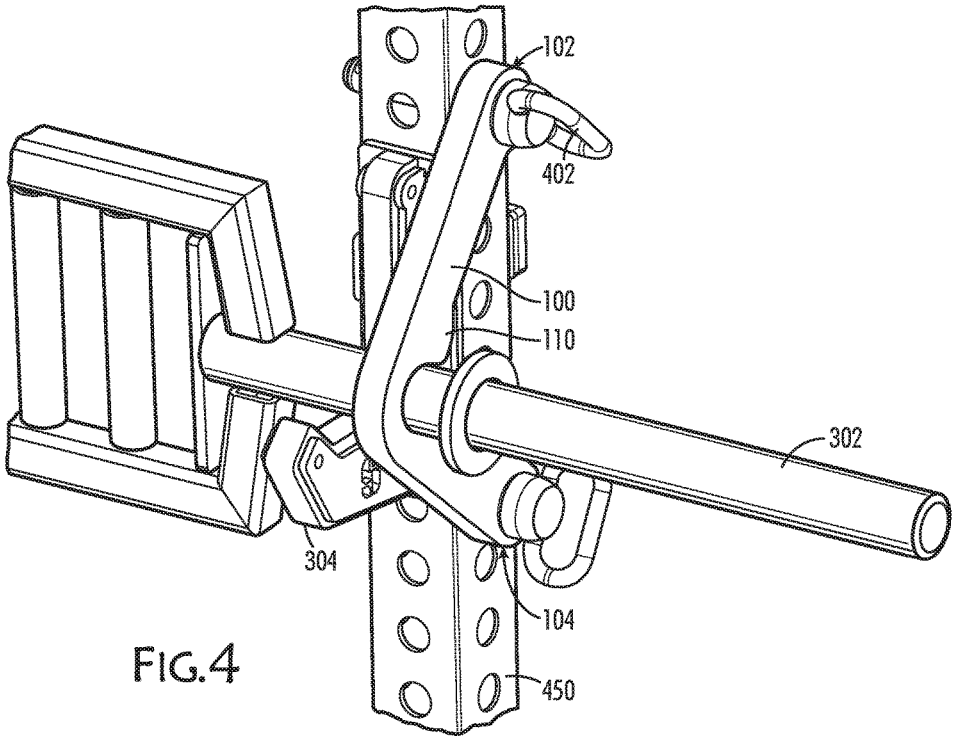
FIG. 4 is an up-close, perspective view of one of the bar securing apparatuses of FIG. 3.

FIG. 4 is an up-close, perspective view of bar securing apparatus 100 and bar holder 304 of FIG. 3, in accordance with an exemplary embodiment of the invention. Also shown in more detail in FIG. 4 is a pin 402, which is inserted into the attachment point 106, and through a corresponding hole in the rack component 450, to secure the bar securing apparatus 100 to the rack component 450. It should be understood that while a pin/hole attachment system is described, any other attachment mechanism could be used to attach the bar securing apparatus to the rack component 450.

Figure 5:
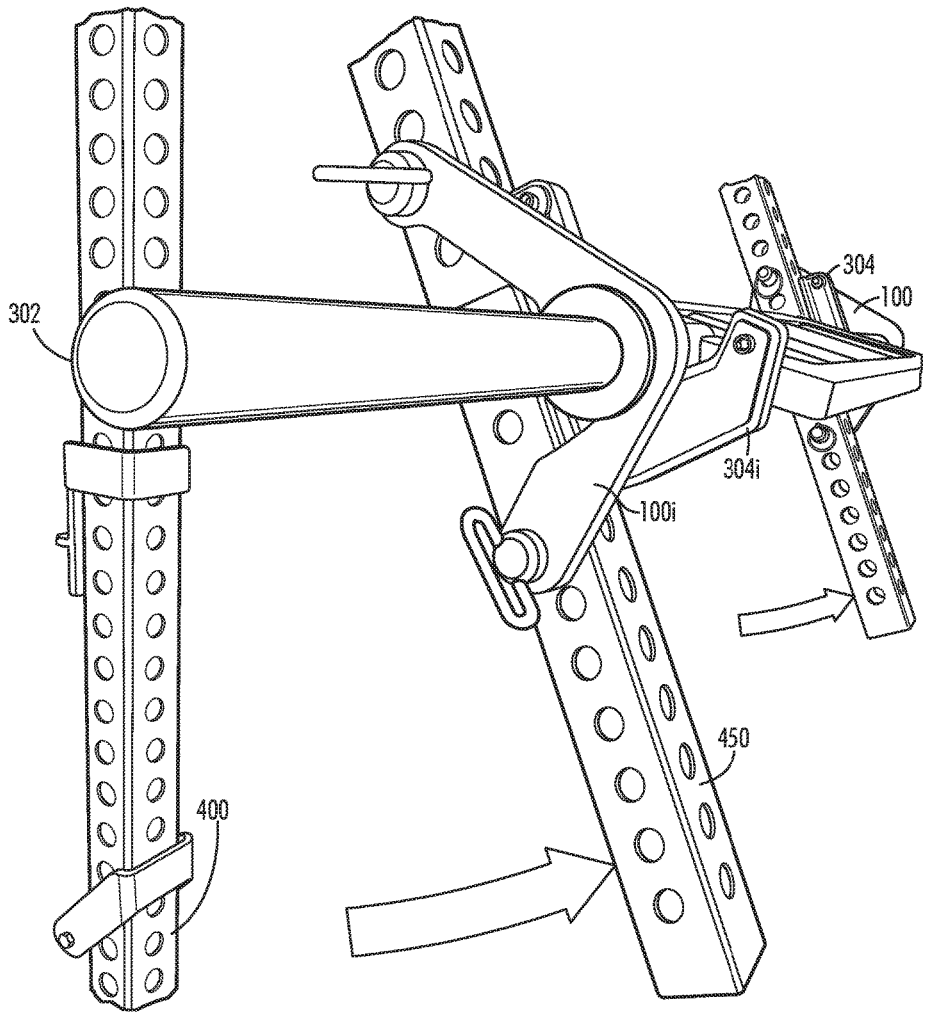
FIG. 5 is a left-side, perspective view of a bar securing apparatus attached to a weight rack or rack component and being used in combination with a bar holder.
Figure 6:
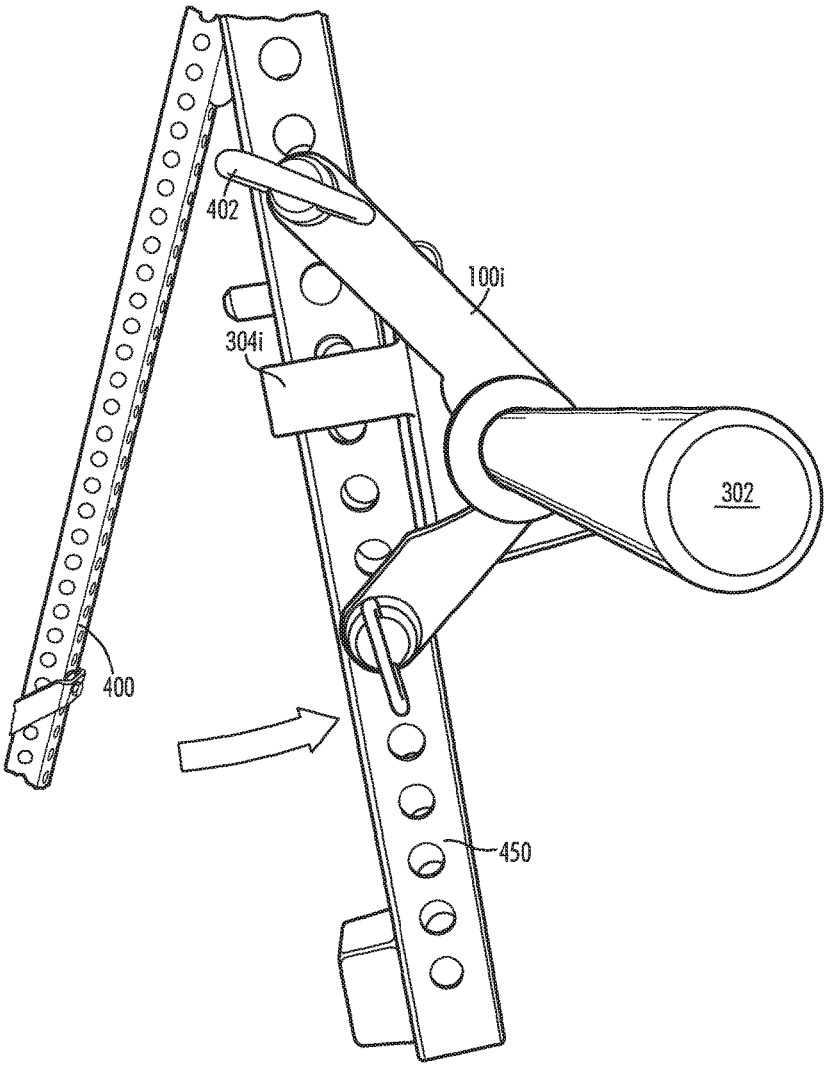
FIG. 6 is a side view of a bar securing apparatus attached to a weight rack or rack component and being used in combination with a bar holder; and, FIG. 7 is a flowchart of a method of using a bar securing apparatus.

FIG. 5 is a left-side, perspective view of bar securing apparatus **100*i* attached to a weight rack 400 or rack component 450 and being used in combination with a bar holder 304*i* to secure the bar 302, in accordance with an exemplary embodiment of the invention. FIG. 6 is a side view of bar securing apparatus 100*i* attached to a weight rack 400 or rack component 450 and being used in combination with a bar holder 304*i***, in accordance with an exemplary embodiment of the invention.

Figure 7:
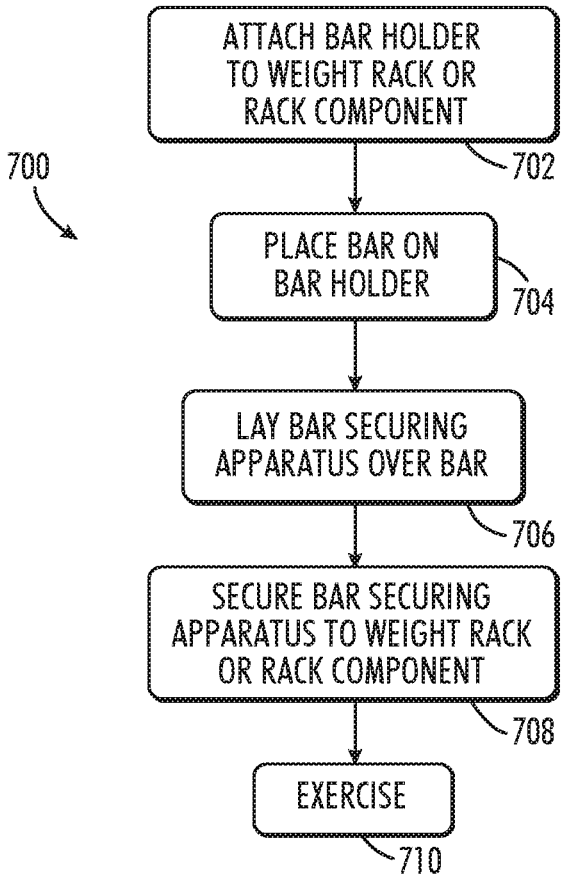

FIG. 7 is a flowchart 700 of a method of using a bar securing apparatus 100, in accordance with an exemplary embodiment of the invention. In an embodiment of the invention, at least one bar holder 304 is attached (702) or previously-attached to a weight rack 400 or rack component 450. A weight bar 302 is placed (704) on the bar holder 304 and a bar securing apparatus 100 is laid (706) over the bar 302, such that the bar is located in the cut-out 108 and under the raised bump 110, in an embodiment of the invention. The bar securing apparatus 100 is secured (708) to the weight rack 400 or rack component 450 such that the bar 302 is trapped/pinned between the at least one bar holder 304 and the at least one bar securing apparatus 100 such that it does not move, or moves minimally, up/down and/or forward/backward.

The user optionally exercises (710) by grasping the bar 302, for example by performing isometric exercises (e.g. pull ups, inverted rows, balance and gymnastic movements), or as the user interface for moving at least one rack component 450 (e.g. moving at least one Sorinex® Jammer Arm™). It should be understood that in most scenarios, the bar holder 304 and/or the bar securing apparatus 100 are used in pairs to suspend the bar 302 across two parallel weight rack 400 or rack component 450 segments (such as shown in FIG. 3), such that the weight bar 302 connects a corresponding pair when it is secured to two parallel weight rack 400 or rack component 450 segments.

It should also be understood that while a single bar securing apparatus is shown on each rack component 450 side/segment of FIG. 3, a second bar securing apparatus could optionally be installed on one or more of the inner surfaces of each of the rack component segments shown (bringing the total number of bar securing apparatuses to 3 or 4), such that the rack component segments are bracketed by the bar securing apparatuses (and on each side, the weight bar 302 is held in place by two bar securing apparatuses 100).

It should also be understood that in some embodiments, the bar 302 is not continuous between the paired weight rack or rack component 450 segments and are, instead, two separate bars or handles which are secured using one or more of the bar securing apparatuses 100, 100*i* described herein.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6 and numbers which fall outside of this range subject to limitations of state-of the art measuring equipment. This applies regardless of the breadth of the range.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A bar securing apparatus for securing a weight bar to a weight rack or rack component, consisting essentially of: an upper end; a lower end; and, a cut-out located between the upper end and the lower end, sized and shaped for placement of a weight bar with a circular cross-section therein, wherein each upper end and the lower end is configured with at least one attachment point for removably receiving pins for securing said apparatus to a weight rack or rack component.

2. The bar securing apparatus of claim 1, wherein the apparatus is L-shaped and wherein the upper end and the lower end are on opposite sides of the L-shape.

3. The bar securing apparatus of claim 1, further comprising a raised bump located between the cut-out and the upper end.

4. The bar securing apparatus of claim 3, wherein a shape of the raised bump is biased towards the cut-out to hold the bar in the cut-out.

5. The bar securing apparatus of claim 1, wherein the at least one attachment point is a hole through the bar securing apparatus.

6. The bar securing apparatus of claim 5, wherein a plurality of attachment points are located on the bar securing apparatus to provide different positional options for attaching the bar securing apparatus to the weight rack or rack component.

7. The bar securing apparatus of claim 1, wherein the bar securing apparatus is substantially planar.

8. The bar securing apparatus of claim 1, wherein the bar securing apparatus is one in a system of a plurality of bar securing apparatuses of varying size and shape.

9. The bar securing apparatus of claim 1, wherein the bar securing apparatus is one in a system of a plurality of bar securing apparatuses configured with at least one of different sized and shaped cut-outs for accommodating at least one of different bar diameters and cross-sectional shapes.

10. A method of using a bar securing apparatus to secure a weight bar to a weight rack or a rack component having at least one bar holder, the weight rack or rack component, comprising: placing the weight bar on the at least one bar holder of the weight rack or rack component; laying at least one bar securing apparatus over the weight bar, such that the weight bar is disposed in a cut-out and under a raised bump of the bar securing apparatus; securing the at least one bar securing apparatus to the weight rack or rack component using at least one attachment point disposed on at least one of an upper end and a lower end of the bar securing apparatus, wherein the weight bar is trapped between the at least one bar holder and the at least one bar securing apparatus.

11. The method of claim 10, further comprising attaching at least one bar holder to the weight rack or rack component.

12. The method of claim 11, further comprising performing placing through securing on a second weight rack or rack component to connect a corresponding pair of weight rack or rack component segments using the weight bar.

13. The method according to claim 12, further comprising performing exercise while grasping the bar.

14. The method according to claim 11, further comprising performing exercise while grasping the bar.

15. The method according to claim 10, further comprising securing a second bar securing apparatus on an opposite side of the weight rack or rack component, such that the weight rack or rack component is bracketed by the bar securing apparatus and the second bar securing apparatus.

16. The method according to claim 12, further comprising securing a second bar securing apparatus on the second weight rack or rack component on an opposite side of the bar securing apparatus, such that the second weight rack or rack component is bracketed by the bar securing apparatus and the second bar securing apparatus.

* * * * *